US006992633B2

(12) United States Patent
Kim et al.

(10) Patent No.: US 6,992,633 B2
(45) Date of Patent: Jan. 31, 2006

(54) MULTI-BAND MULTI-LAYERED CHIP ANTENNA USING DOUBLE COUPLING FEEDING

(75) Inventors: Hyun Hak Kim, Kyungki-do (KR); Chul Ho Kim, Kyungki-do (KR); Gi Tae Do, Kyungki-do (KR); Jeong Sik Seo, Daejeon (KR); Il Hwan Park, Kyungki-do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 15 days.

(21) Appl. No.: 10/859,145

(22) Filed: Jun. 3, 2004

(65) Prior Publication Data

US 2005/0248489 A1 Nov. 10, 2005

(30) Foreign Application Priority Data

May 4, 2004 (KR) ..... 10-2004-0031297

(51) Int. Cl.
*H01Q 1/24* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 6,529,170 B1 * 3/2003 Nishizawa et al. ..... 343/795
6,738,023 B2 * 5/2004 Scott et al. ..... 343/700 MS
6,765,539 B1 * 7/2004 Wang et al. ..... 343/795
6,784,843 B2 * 8/2004 Onaka et al. ..... 343/700 MS
6,819,289 B2 * 11/2004 Kim et al. ..... 343/700 MS
2003/0227411 A1 12/2003 Kim et al. ..... 343/700 MS
2004/0119644 A1 * 6/2004 Puente-Baliarda et al. .. 343/700 MS
2005/0128151 A1 * 6/2005 Kwak et al. ..... 343/702

FOREIGN PATENT DOCUMENTS

EP 0 777 293 6/1997
EP 1 098 387 5/2001

* cited by examiner

*Primary Examiner*—Tho Phan
(74) *Attorney, Agent, or Firm*—Lowe Hauptman & Berner, LLP

(57) ABSTRACT

Disclosed herein is a multi-layered chip antenna using double coupling feeding. The multi-layered chip antenna comprises a first feeding radiation element including a first feeding electrode connected at one side of the first feeding electrode to a feeding line and connected at the other side thereof to a ground surface while being formed on a first plane in a predetermined direction, the first feeding radiation element being connected to the first feeding electrode so that the first feeding radiation element has a spatial meander line structure, a second feeding radiation element connected to a portion of the first feeding electrode on a second plane parallel to the first plane such that the second feeding radiation element has a planar meander line structure, a second feeding electrode connected to a portion of the first feeding electrode on a third plane parallel to the first plane, a first parasitic radiation element electrically coupled to the second feeding electrode, and a second parasitic radiation element electrically coupled to the second feeding electrode and comprising a plurality of parasitic patterns.

14 Claims, 8 Drawing Sheets

MULTI-BAND MULTI-LAYERED CHIP ANTENNA USING DOUBLE COUPLING FEEDING

BACKGROUND OF THE INVENTION

1. Field of the Invention

The present invention relates to a multi-band multi-layered chip antenna, which can be mounted in GSM (Global System for Mobile communication), DCS (Digital Europe Cordless Telephone) and BT (Bluetooth) terminals, and particularly to a multi-band multi-layered chip antenna using double coupling feeding, which realizes multi-band characteristics using a feeding radiation element and double parasitic radiation elements in the chop antenna, so that with impedance adjustment between the double parasitic elements, control of frequency and bandwidth, enhancement of impedance characteristics and radiation efficiency, and minimized influence of mutual impedance between the radiation elements can be realized.

2. Description of the Related Art

In general, as for an antenna applicable to mobile communication terminals, such as GSM, DCS, BT and the like, a helical antenna formed as an outward protrusion on the communication terminal or a linear monopole antenna retractable into the communication terminal are mainly used. Although such a helical antenna or a monopole antenna has an advantage of a non-directional radiation characteristic, since these antennas are an external type in which the antenna is protruded outward from the terminal, there are worries about damage of an appearance due to an external force, leading to deterioration of the characteristics, and these antennas have a low Specific Absorption Rate (SAR), which has been proposed recently.

Meanwhile, recent requirements of the mobile communication terminals are miniaturization, lightweight and multi-functionality. In order to satisfy these requirements, built-in circuits and components to be employed in the communication terminal also have tendencies toward the miniaturization as well as the multi-functionality. These tendencies of miniaturization and multi-functionality are also required of the antenna, one of the most important components of the communication terminal.

As for conventional built-in type antennas, there are micro-strip patch antennas, planar inverted F-type antennas, chip antennas, and the like. There are suggested methods of effectively miniaturizing these built-in type antennas. For instance, there is a method by which the micro-strip patch antenna having a relatively high gain and wide bandwidth characteristics is reduced in size using an aperture coupled feeding structure. According to this method, with an electric field distribution of $TM_{01}$ mode of the micro-strip patch antenna, the dielectrics are inserted in the longitudinal direction of a resonance patch to a lower portion of an edge of the patch where the electric field distribution is highest, effectively reducing the size of the antenna and minimizing gain reduction in the antenna, which can occur due to an increase of the dielectric constant, thereby providing a lightweight, miniaturized antenna.

However, since the method of miniaturizing the currently available antenna is based on a planar structure, there is a limitation in miniaturization, and when considering the current tendency of reducing space for the antenna to be mounted in a PDA (Personal Digital Assistant) caused by an increase in service of the PDA, there is a need to provide an enhanced method.

Further, although inverse L-type, inverse F-type and the like are used as feeding type antennas used in the conventional antennas, there is a need to enhance the feeding type in view of space efficiency.

FIG. 1 is a perspective view illustrating the structure of a conventional multi-layered chip antenna.

The conventional multi-layered chip antenna shown in FIG. 1 is an antenna miniaturized such that the antenna can be used in the multi-band, in which first and second radiation patches 30 and 40 of the antenna are coupled to each other via a feeding part 20 at an upper portion of one edge of a ground metal plate 10, and the feeding part 20 is coupled to the ground metal plate 10 in the perpendicular direction.

The first radiation patch 30 defining the top surface of the antenna has a labyrinth-shaped fold slit patch structure, and is parallel to the planar upper surface of the ground metal plate 10.

The second radiation patch 40 is positioned between the first radiation patch 30 and the ground metal plate 10 while being parallel to the first radiation patch 30 and the ground metal plate 10. The secondary radiation patch 40 comprises a plurality of strip patches 41 and 43 having lengths and widths different from each other, respectively, and each of the strip patches 41 and 44 can be positioned on an identical plane, or can be laminated with each other.

The feeding part 20 comprises a feeding pattern 21, a feeding pattern extension 22, a feeding pattern ground portion 23, and the like. The feeding pattern 21 acts to transmit signals between a body of the PDA and the first and second radiation patches 30 and 40 of the antenna, and is perpendicularly coupled to a feeding metal conductor provided at one side of the ground metal plate 10. The feeding pattern extension 22 extends perpendicular to the feeding pattern 21 from a predetermined portion of the feeding pattern 21, and the length of the feeding pattern extension 21 can be varied. The feeding pattern extension 22 is bent toward the ground metal plate 10 at the end of the feeding pattern extension 22, grounded to the ground metal plate 10.

Meanwhile, although the conventional multi-layered chip antenna can be available in multi-band and have a miniaturized structure, there are problems as follows.

First, since the first radiation patch 30 constituting the antenna has patterns, almost all of which are formed on one plane, and the second radiation patch 40 has the other patterns, almost all of which are formed on the other plane, there is a problem in that the miniaturization of the antenna is limited.

Further, since both patterns of the first and second radiation patches 30 and 40 constituting the antenna respectively have shapes of a substantially straight line, there is a problem in that the miniaturization of the antenna is limited.

Additionally, since both the first and second radiation patches are directly coupled to the feeding line, if there is a need to adjust a frequency due to a process variation after manufacturing the antenna according to a predetermined design, change of one patch has a direct influence on the other patch connected to the patch, thereby making frequency operation difficult.

SUMMARY OF THE INVENTION

The present invention has been made to solve the above problems, and it is an object of the present invention to provide a multi-band multi-layered chip antenna using double coupling feeding, which realizes multi-band characteristics using a feeding radiation element and double parasitic radiation elements of a chip antenna, so that controls of frequency and bandwidth, enhancement of impedance characteristics and radiation efficiency, and minimized influence of mutual impedance between the radiation elements can be realized through impedance adjustment between the double parasitic elements.

In accordance with one aspect of the present invention, the above and other objects can be accomplished by the provision of a multi-band multi-layered chip antenna using double coupling feeding, comprising: a first feeding radiation element including a first feeding electrode connected at one side of the first feeding electrode to a feeding line and connected at the other side thereof to a ground surface while being formed on a first plane in a predetermined direction, the first feeding radiation element being connected to the first feeding electrode so that the first feeding radiation element has a spatial meander line structure; a second feeding radiation element connected to a portion of the first feeding electrode on a second plane parallel to the first plane so that the second feeding radiation element has a planar meander line structure; a second feeding electrode connected to a portion of the first feeding electrode on a third plane parallel to the first plane; a first parasitic radiation element electrically coupled to the second feeding electrode; and a second parasitic radiation element electrically coupled to the first parasitic radiation element and comprising a plurality of parasitic patterns.

BRIEF DESCRIPTION OF THE DRAWINGS

The foregoing and other objects and features of the present invention will be more clearly understood from the following detailed description taken in conjunction with the accompanying drawings, in which.

DESCRIPTION OF THE PREFERRED EMBODIMENTS

Figure 1:
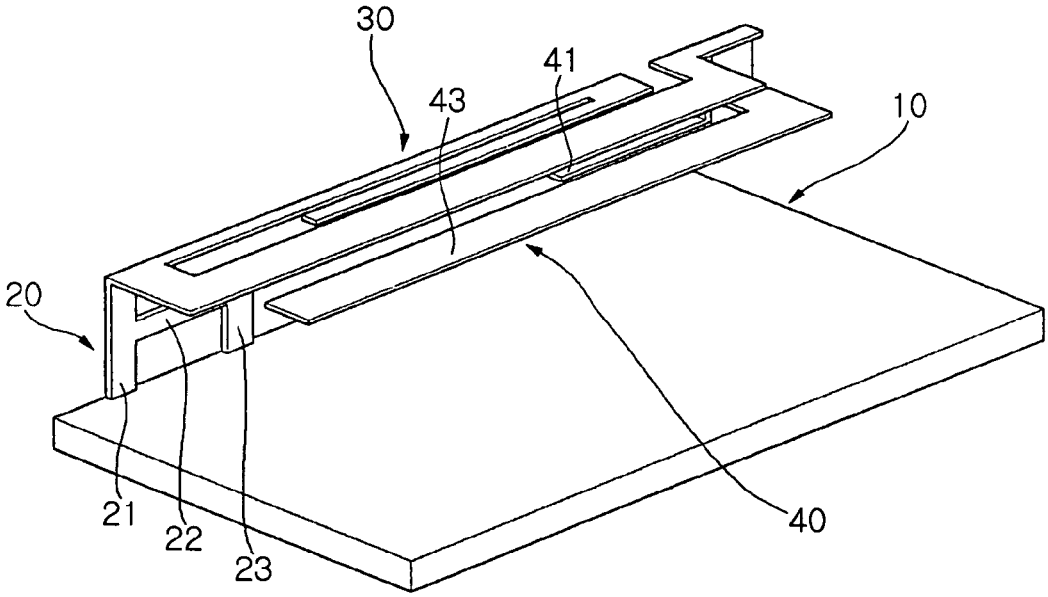
PRIOR ART FIG. 1
FIG. 1 is a perspective view illustrating the structure of a conventional multi-layered chip antenna.

Preferred embodiments will now be described in detail with reference to the accompanying drawings.

Like components, which have substantially identical structures and functions, will be denoted by like reference numerals.

A multi-layered chip antenna of the present invention is not a general PIFA-type antenna but a built-in type multi-layered ceramic chip antenna, wherein a GSM band is basically realized using a meander line and an inverse F-type provided in the chip antenna and a DCS band is realized using parasitic elements provided at the upper layer of the antenna. Further, the multi-layered chip antenna of the present invention has advantages in that with a structural modification for adjusting coupling of the parasitic elements at the upper layer, embodiment of triple bands, adjustment of a central frequency, and enlargement of the bandwidth can be realized.

Figure 2:
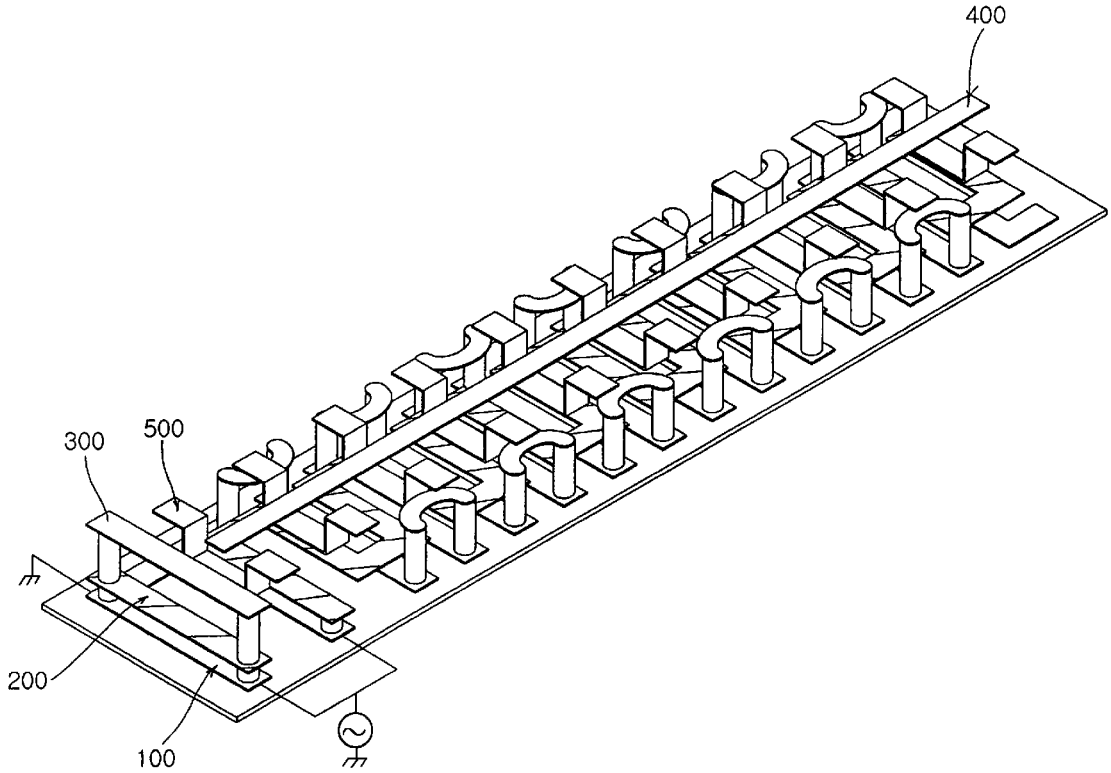
FIG. 2 is a perspective view illustrating the structure of a multi-layered chip antenna according to the present invention.
Figure 3:
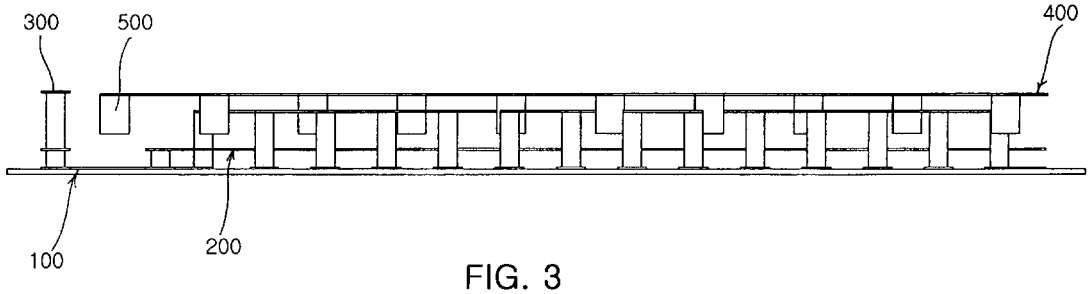
FIG. 3 is a front view of the multi-layered chip antenna of FIG. 2.

FIG. 2 is a perspective view illustrating the structure of a multi-layered chip antenna according to the present invention, and FIG. 3 is a front view of the multi-layered chip antenna of FIG. 2.

Referring to FIGS. 2 and 3, the multi-layered chip antenna according to the present invention comprises: a first feeding radiation element 100 including a first feeding electrode 110 connected at one side of the first feeding electrode to a feeding line and connected at the other side thereof to a ground surface while being formed on a first plane in a predetermined direction, the first feeding radiation element being connected to the first feeding electrode so that the first feeding radiation element has a spatial meander line structure; a second feeding radiation element 200 connected to a portion of the first feeding electrode 110 on a second plane parallel to the first plane so that the second feeding radiation element has the a planar meander line structure; a second feeding electrode 300 connected to another portion of the first feeding electrode 110 on a third plane parallel to the first plane; a first parasitic radiation element 400 electrically coupled to the second feeding electrode 300; and a second parasitic radiation element 500 electrically coupled to the first parasitic radiation element 400 and comprising a plurality of parasitic patterns 510–590 and 595.

The multi-band chip antenna of the present invention comprises the feeding radiation elements 100 and 200 and double parasitic radiation elements 400 and 500, by which resonance frequencies of GSM, DCS, and BT are generated, respectively. Further, the multi-band chip antenna of the present invention improves the bandwidth in a single frequency by adjoining the resonance frequencies thereof to each other. Specifically, the multi-band chip antenna comprises the second feeding radiation element 200 having the meander line structure for providing a GSM band of 880~960 MHz and a Bluetooth band of 2.4~2.48 GHz, the first feeding radiation element 100 having an inverse F structure and the spatial meander line structure, and double parasitic radiation elements 400 and 500 for providing a DCS band of 1,710~1,880 MHz.

Here, the second feeding radiation element 200 has the meander line structure, in which the frequency can be adjusted by controlling a width and a space of the lines in this structure. Further, the first feeding radiation element 100 has the inverse F structure and the spatial meander line structure, in which the operating frequency can be adjusted by controlling a width of the lines in these structures.

Thus, the GSM band of 880~960 MHz and the Bluetooth band of 2.4~2.48 GHz are provided by a combined structure of the meander line structure of the second feeding radiation structure 200, and the inverse F structure and the meander line structure of the first feeding radiation structure 100.

Figure 4:
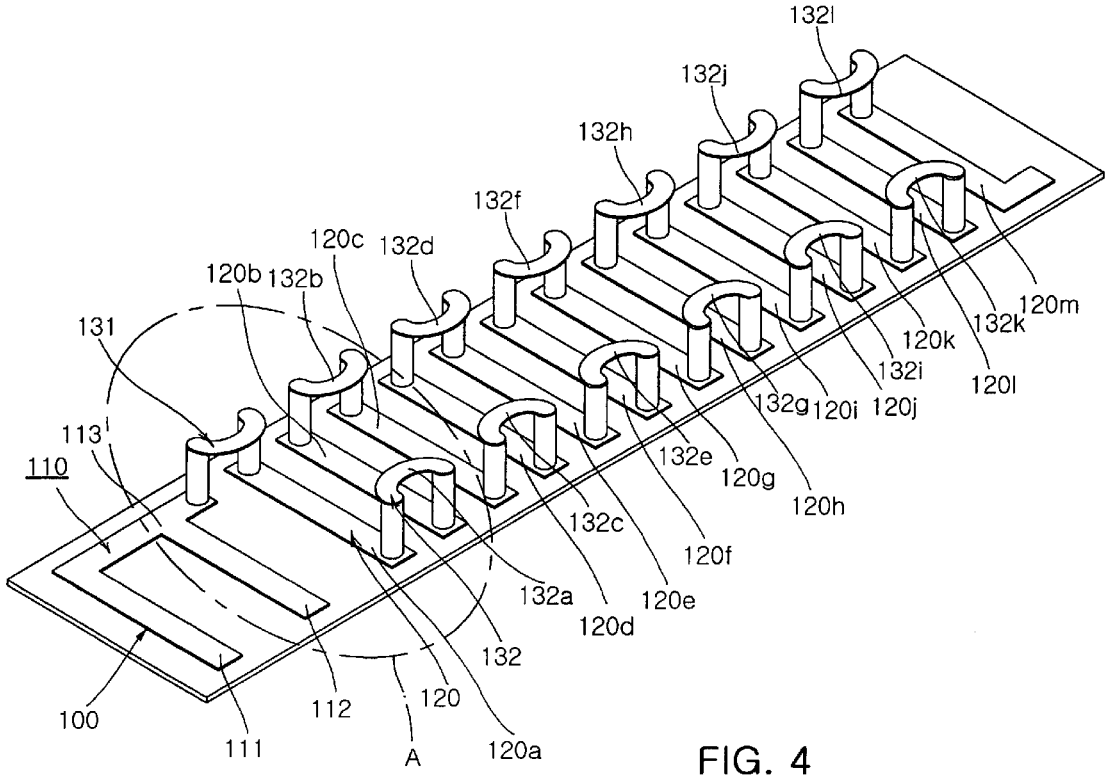
FIG. 4 is a perspective view of a first feeding radiation element of the present invention.

FIG. 4 is a perspective view of the first feeding radiation element of the present invention.

Referring to FIG. 4, the first feeding radiation element 100 is parallel to the first feeding electrode 110, and comprises a plurality of strip lines 120 (120*a* ~120*m*) spaced from each other by a predetermined distance while being parallel to each other, a first connecting pattern 131 for connecting one strip line 120*a* adjacent to the first feeding electrode 110 among the plurality of strip lines 120 to the first feeding electrode 110, and a second connecting pattern 132 comprising a plurality of patterns 132*a* ~132*l*, which respectively connect two adjoining strip lines among the plurality of strip lines 120, thereby forming the meander line structure.

Here, the first connecting pattern 131 and the second connecting pattern 132 are formed on the plane different from the first plane while being parallel to the first plane. That is, as shown in FIGS. 2 and 4, the connecting patterns for connecting the plurality of strip lines are formed on the plane different from the first plane on which the strip lines are formed, so that the first feeding radiation element 100 forms the spatial meander line structure.

The first feeding electrode 110 of the first feeding radiation element 100 is connected at one side of the first feeding electrode 110 to the feeding line, and connected at the other side thereof to the ground plane. The first feeding electrode 110 comprises two feeding patterns 111 and 112 parallel to the first plane, and a feeding connecting pattern 113 for connecting adjacent ends of the feeding patterns 111 and 112. The first feeding electrode 110 has the inverse F shape.

Figure 5:
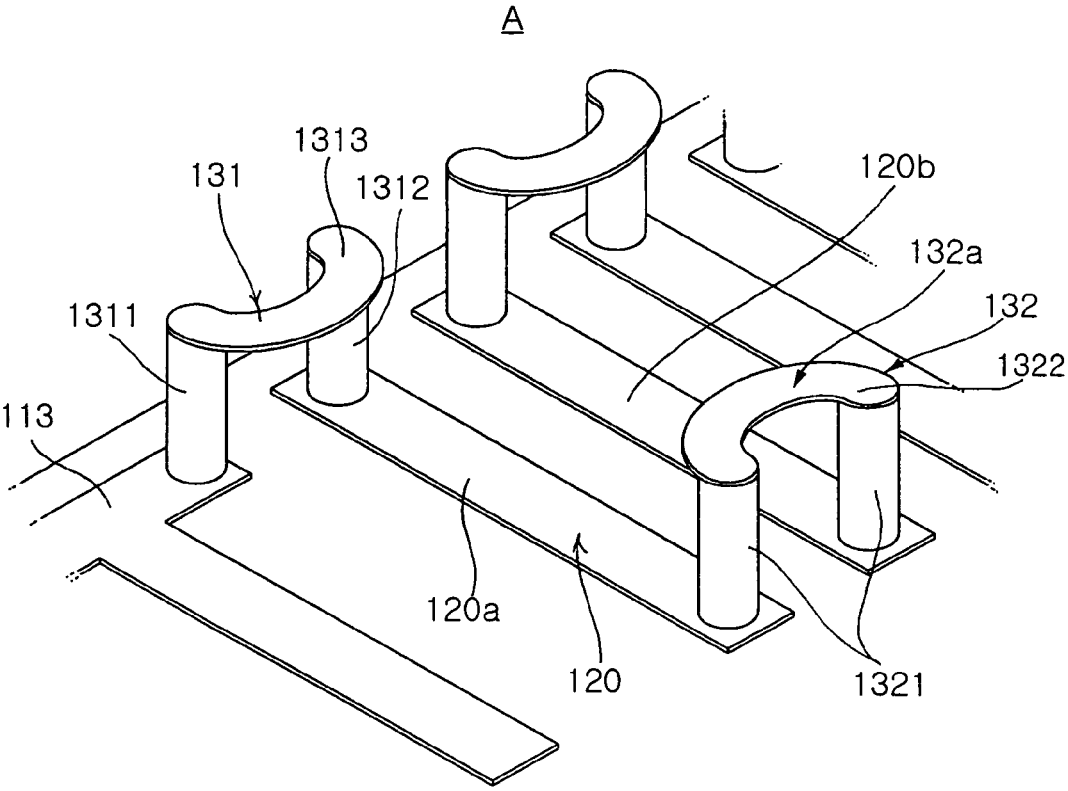
FIG. 5 is an enlarged perspective view illustrating a portion A of FIG. 4.

FIG. 5 is an enlarged perspective view illustrating a portion A of FIG. 4.

Referring to FIG. 5, the first connecting pattern 131 of the first feeding radiation element 100 comprises a first vertical connecting pattern 1311 formed upward from the end of the first feeding electrode 110, a second vertical connecting pattern 1311 formed upward from the end of the strip line 120*a* adjacent to the first feeding electrode among the plurality of strip lines 120*a* ~120*m*, and a horizontal connecting pattern 1313 connecting the first and second vertical connecting patterns 1311 and 1312 on the plane different from the first plane while being parallel to the first plane.

Further, referring to FIG. 5, the second connecting pattern 132 of the first feeding radiation element 100 comprises a plurality of vertical connecting patterns 1321 formed upward from each end of the plurality of strip lines 120*a* ~120*m*, a plurality of horizontal patterns connecting two adjacent vertical patterns to each other as a pair of the vertical patterns among the plurality of vertical connecting patterns 1321 on the other plane parallel to the first plane. The plurality of horizontal patterns are a plurality of horizontal connecting patterns 1322, which do not overlap and/or connect to each other but are separated from each other in a zigzag shape.

The plurality of horizontal connecting patterns 1322 of the first feeding radiation element 100 is formed on the plane between the second plane formed with the second feeding radiation element 200 and the third plane formed with the second feeding electrode 300. Further, the horizontal connecting patterns 1322 of the first feeding radiation element 100 can be formed in a non-linear pattern or in a linear pattern.

Figure 6:
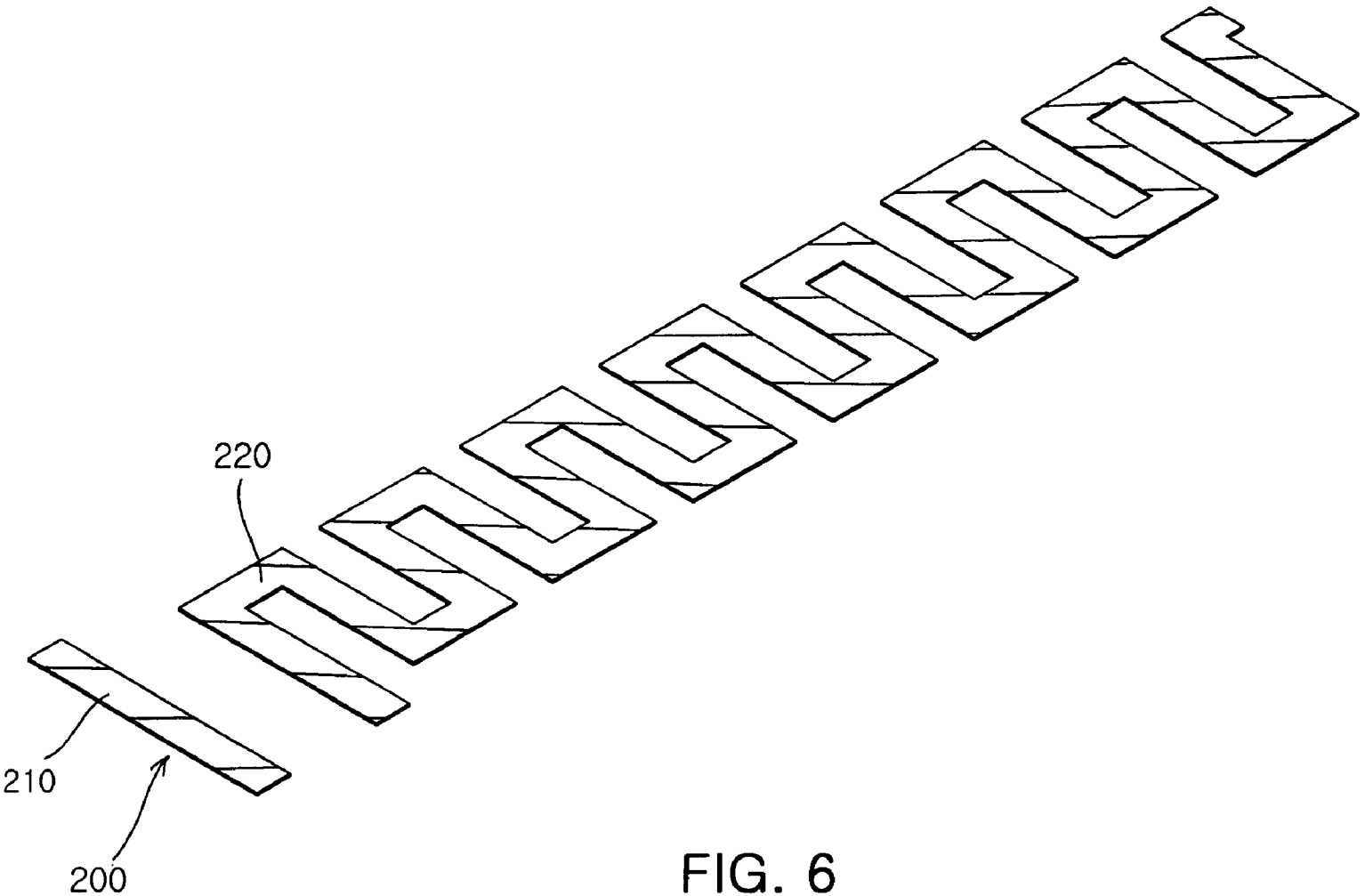
FIG. 6 is a perspective view of a second feeding radiation element of the present invention.

FIG. 6 is a perspective view of the second feeding radiation element of the present invention.

Referring to FIG. 6, the second feeding radiation element 200 comprises a feeding pattern 210 connected to one pattern of the first feeding element 110 and a radiation pattern 220 connected to the other pattern 112 of the first feeding element 110 to have the meander line structure.

Further, the second feeding electrode 300 is formed in parallel to one feeding pattern 111 of the first feeding element 110 in the same direction as that of one feeding pattern 111 on the plane different from the first plane while being parallel to the first plane.

Figure 7:
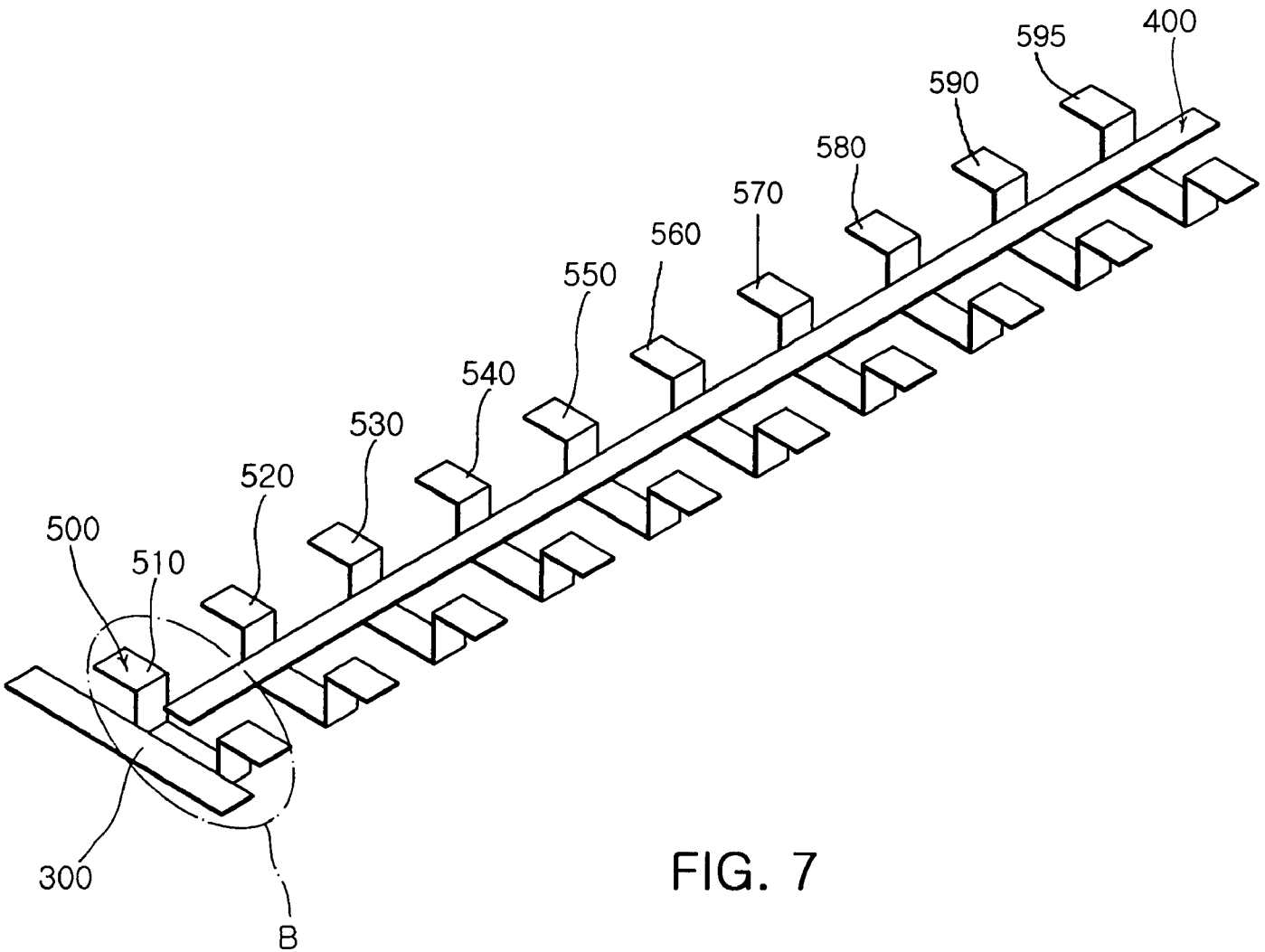
FIG. 7 is a perspective view of double parasitic elements of the present invention.

FIG. 7 is a perspective view of the double parasitic radiation element of the present invention.

As shown in FIG. 7, the first parasitic radiation element 400 is formed perpendicular to the second feeding electrode 300, thereby forming a first coupling along with the second feeding electrode 300. The second parasitic radiation element 500 is formed perpendicular to the first feeding electrode 400, thereby forming a second coupling along with the first parasitic radiation element 400.

Figure 8:
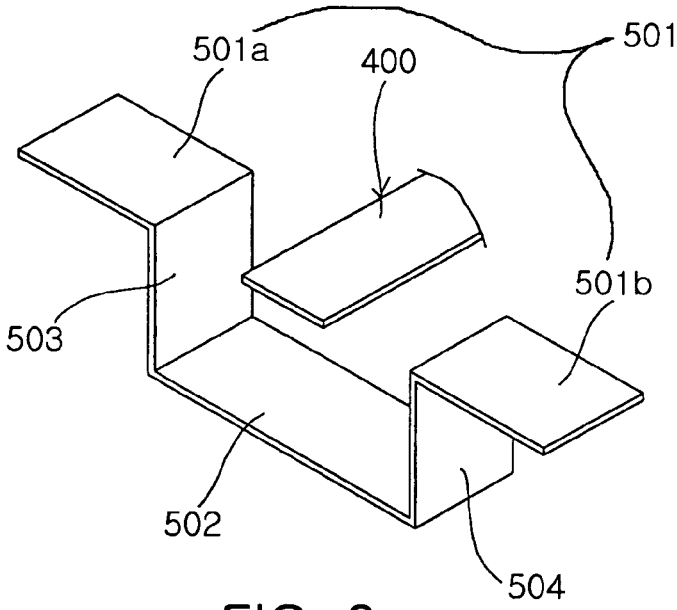
FIG. 8 is an enlarged perspective view illustrating a portion B of FIG. 7.

FIG. 8 is an enlarged perspective view illustrating a portion B of FIG. 7.

Referring to FIG. 7, the plurality of parasitic patterns 510~590 and 595 of the second parasitic radiation element 500 comprise lower patterns 502 formed at a lower part of the first parasitic radiation element in the perpendicular direction to the first parasitic radiation element 400, respectively.

Further, in addition to the lower pattern 502 formed at the lower part of the first parasitic radiation element 400 in the direction perpendicular to the first parasitic radiation element 400, each of the plurality of parasitic patterns 510~590 and 595 of the second parasitic radiation element 500 comprises: both sides patterns 501 including first and second patterns 501*a* and 501*b* spaced from the first parasitic radiation element 400 by a predetermined distance at either side of the first parasitic radiation element 400 while having a predetermined length, respectively, in the direction perpendicular to the first parasitic radiation element 400; a first connecting pattern 503 connecting one end of the first pattern 501*a* and one end of the lower pattern 502 so that they are perpendicular to each other; and a second connecting pattern 504 connecting one end of the second pattern 501*b* and the other end of the lower pattern 502 so that they are perpendicular to each other.

Here, the second parasitic radiation element 500 has a structure for realizing a second coupling feeding. For instance, the coupling can be controlled only with the lower patterns 502 perpendicularly formed at the lower part of the first parasitic radiation element 400. Further, it is desirable that second parasitic radiation element 500 further comprises both sides patterns 501 connected to the lower patterns 502 via the first and second connecting patterns 503 and 504. With the coupling having the above structure, the bandwidth in the DCS band, the radiation characteristics, the impedance between parasitic elements, and the total impedance of the antenna can be adjusted.

Here, the plurality of parasitic patterns 510~590 and 595 of the second parasitic radiation element 500 can be uniformly spaced from each other.

That is, referring to FIGS. 7 and 8, the first and second parasitic radiation elements 400 and 500 of the present invention are the parasitic radiation elements for providing the DCS band. The first parasitic radiation element 400 is extended in the lengthwise direction of the antenna, whereas the plurality of parasitic patterns 510~590 and 595 of the second parasitic radiation element 500 are uniformly spaced from each other centering on the first parasitic radiation element 400 while being perpendicular to the first parasitic radiation element 400.

The first parasitic radiation element 400 is coupled to the second feeding electrode 300, which is connected to the first feeding electrode via a feeding via hole, and resonates in the DCS band, of which the central frequency can be adjusted by controlling the spaces between the plurality of parasitic patterns of the second parasitic radiation element 500 perpendicular to the first parasitic radiation element 400 and the number of the parasitic patterns of the second parasitic radiation element 500.

Further, referring to FIGS. 7 and 8, the first and second parasitic radiation elements of the present invention are the parasitic radiation elements for realizing the DCS band. Unlike a feeding radiation element for controlling an operating frequency according to a length of the conductor's pattern (that is, Inductance), the first and second parasitic radiation elements of the present invention can adjust the frequency using the coupling (that is, Capacitance) in order to realize the DCS band. That is, since electric current is induced in the first parasitic radiation element 400 by mutual coupling (a first coupling feeding), inductance can be adjusted with the second parasitic radiation element formed perpendicular to the first parasitic radiation element 400 to form capacitance together with the first parasitic radiation element 400, and thus the operating frequency can be controlled therewith.

When the DCS band is realized using the double parasitic radiation elements consisting of the first and second parasitic radiation elements 400 and 500, for instance, when the DCS band is realized using the radiation element connected to the feeding electrode, change of one feeding radiation element can prevent a total impedance of the antenna from being deformed, and the central frequency can be easily provided and controlled with an influence of the mutual impedance between the radiation elements. As a result, when realizing the double parasitic radiation elements, not only can control of frequency and the central frequency be obtained through a structural modification (such as dimension, shape and the number) of the parasitic element only in consideration of the mutual impedance caused by the parasitic element, but the bandwidth can also be widened using the coupling.

Further, the bandwidth can be adjusted by varying the number of the plurality of parasitic patterns 510~590 and 595 of the second parasitic radiation element 500, and the operating frequency can be controlled by adjusting the space between the parasitic elements formed in the perpendicular direction, with the plurality of parasitic patterns 510–590 and 595 maintained in an identical structure in the lengthwise direction. For instance, the space of the second parasitic element formed in the perpendicular direction can be set in the range of about $2/\lambda$~$8/\lambda$.

Figure 9A:
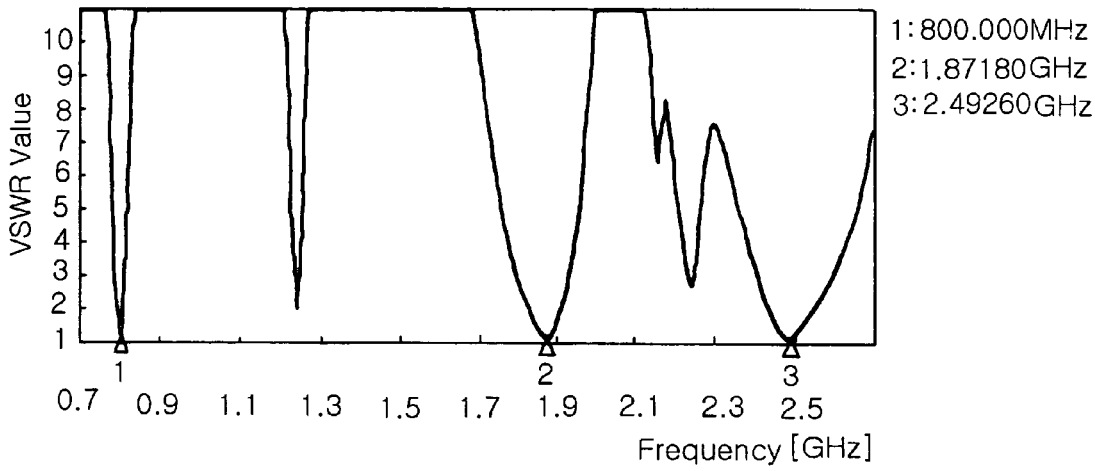
FIGS. 9*a* and 9*b* are graphical representations of VSWR characteristic of the chip antenna according to the present invention.
Figure 9B:
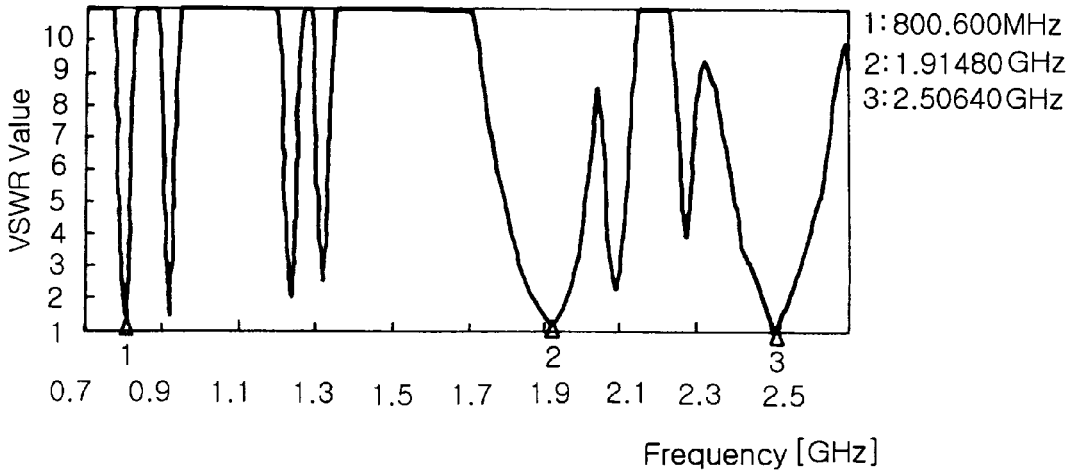

In the present invention, a bandwidth characteristic of the multi-layered chip antenna according to an increase of the number of the second parasitic radiation elements coupled to the first parasitic radiation element is shown in FIGS. 9*a* and 9*b*.

FIGS. 9*a* and 9*b* are graphical representations of a VSWR characteristic of the chip antenna according to the present invention.

The VSWR characteristic of the chip antenna of the present invention were measured after mounting the first and second parasitic radiation elements realizing in the DCS bandwidth in a real set, with the GSM and BT bandwidth fixed, and the results are shown in FIGS. 9*a* and 9*b*. The results show that when the chip antenna is mounted in the real set, the operating frequency is varied from the operating frequency designed to operate in respective operating bands.

FIG. 9*a* shows the result when using the double parasitic radiation elements of the present invention, by which it can be seen that at a point VSWR[1:1.1480], the frequency formed with an upper pole of the band is at about 1.87 GHz. In FIG. 9*b*, it can be seen that as the number of the second parasitic radiation elements formed in the perpendicular direction is increased, at a point VSWR[2:1.2460], the frequency formed with an upper pole of the band is at about 1.915 GHz, which is higher about 45 MHz, compared with the frequency of FIG. 9*b*.

According to the results, the band of the multi-layered chip antenna according to the increase of the number of the second parasitic radiation element coupled to the first parasitic radiation element can be adjusted, and the bandwidth thereof can be widened.

Since the feeding radiation element and the parasitic radiation elements are realized in one chip, the ceramic chip antenna of the present invention must adjust difficult characteristics, such as mutual coupling effects, the mutual impedance and the radiation characteristic in each band. Thus, the present invention realizes these characteristics to an applicable level.

As apparent from the above description, according to the present invention, there are advantageous effects in that the multi-band multi-layered chip antenna, which can be mounted in the GSM, DCS and BT terminals, realizes the multi-band characteristics using the feeding radiation element and the double parasitic elements of the chip antenna, so that control of the frequency and the bandwidth, enhancement of the impedance characteristics and the radiation efficiency, minimized influence of mutual impedance between the radiation elements can be obtained by adjusting the impedance between the double parasitic elements.

It should be understood that the embodiments and the accompanying drawings as described above have been described for illustrative purposes and the present invention is limited by the following claims. Further, those skilled in the art will appreciate that various modifications, additions and substitutions are allowed without departing from the scope and spirit of the invention as set forth in the accompanying claims.

What is claimed is:

1. A multi-band multi-layered chip antenna using double coupling feeding, comprising:

a first feeding radiation element including a first feeding electrode connected at one side of the first feeding electrode to a feeding line and connected at the other side thereof to a ground surface while being formed on a first plane in a predetermined direction, the first feeding radiation element being connected to the first feeding electrode so that the first feeding radiation element has a spatial meander line structure;

a second feeding radiation element connected to a portion of the first feeding electrode on a second plane parallel to the first plane so that the second feeding radiation element has a planar meander line structure;

a second feeding electrode connected to a portion of the first feeding electrode on a third plane parallel to the first plane;

a first parasitic radiation element electrically coupled to the second feeding electrode; and a second parasitic radiation element electrically coupled to the first parasitic radiation element and comprising a plurality of parasitic patterns.

2. The multi-band multi-layered chip antenna as set forth in claim 1, wherein the first feeding radiation element comprises:

a plurality of strip lines spaced from each other at a predetermined distance while being parallel to the first feeding electrode;

a first connecting pattern connecting one strip line adjacent to the first feeding electrode among the plurality of strip lines to the first feeding electrode; and a second connecting pattern comprising a plurality of patterns respectively connecting two adjoining strip lines among the plurality of strip lines to form the meander line structure.

3. The multi-band multi-layered chip antenna as set forth in claim 2, wherein the first connecting pattern of the first feeding radiation element comprises:

a first vertical connecting pattern formed upward from the end of the first feeding electrode, a second vertical connecting pattern formed upward from the end of the strip line adjacent to the first feeding electrode among the plurality of strip lines; and a horizontal connecting pattern for connecting the first and second vertical connecting patterns on a plane different from the first plane while being parallel to the first plane.

4. The multi-band multi-layered chip antenna as set forth in claim 2, wherein the second connecting pattern of the first feeding radiation element comprises:

a plurality of vertical connecting patterns formed upward from each end of the plurality of strip lines; and a plurality of horizontal connecting patterns for connecting two adjacent vertical patterns to each other as a pair of the vertical patterns among the plurality of vertical connecting patterns on the plane different from the first plane while being parallel to the first plane, the plurality of horizontal patterns being formed separately from each other.

5. The multi-band multi-layered chip antenna as set forth in claim 4, wherein the horizontal connecting patterns of the first feeding radiation element is formed on the plane between the second plane formed with the second feeding radiation element and the third plane formed with the second feeding electrode.

6. The multi-band multi-layered chip antenna as set forth in claim 4, wherein the horizontal connecting patterns of the first feeding radiation element are formed in a non-linear pattern.

7. The multi-band multi-layered chip antenna as set forth in claim 4, wherein the horizontal connecting patterns of the first feeding radiation element are formed in a non-linear pattern.

8. The multi-band multi-layered chip antenna as set forth in claim 1, wherein the first feeding electrode of the first feeding radiation element comprises:

two feeding patterns connected at one side of the first feeding pattern to the feeding line and connected at the other side thereof to the ground surface while being parallel to the first plane; and a feeding connecting pattern for connecting adjacent ends of the feeding patterns, and the first feeding electrode has an inverse F shape.

9. The multi-band multi-layered chip antenna as set forth in claim 8, wherein the second feeding radiation element comprises:

a feeding pattern connected to one pattern of the first feeding element; and a radiation pattern connected to the other pattern of the first feeding element to have the meander line structure.

10. The multi-band multi-layered chip antenna as set forth in claim 8, wherein the second feeding electrode is formed in parallel to one feeding pattern of the first feeding element in the same direction as that of one feeding pattern of the first feeding element.

11. The multi-band multi-layered chip antenna as set forth in claim 1, wherein the first parasitic radiation element is formed in the direction perpendicular to the second feeding electrode.

12. The multi-band multi-layered chip antenna as set forth in claim 1, wherein each of the plurality of parasitic patterns of the second parasitic radiation element comprises a lower pattern at a lower part of the first parasitic radiation element in the perpendicular direction to the first parasitic radiation element.

13. The multi-band multi-layered chip antenna as set forth in claim 1, wherein each of the plurality of parasitic patterns of the second parasitic radiation element comprises:

both sides patterns including first and second patterns spaced from the first parasitic radiation element by a predetermined distance at either side of the first parasitic radiation element while having a predetermined length, respectively, in the direction perpendicular to the first parasitic radiation element;

a lower pattern formed at a lower part of the first parasitic radiation element in a direction perpendicular to the first parasitic radiation element;

a first connecting pattern connecting one end of the first pattern among the both sides patterns and one end of the lower pattern so that they are perpendicular to each other; and a second connecting pattern connecting one end of the second pattern among the both sides patterns and the other end of the lower pattern so that they are perpendicular to each other.

14. The multi-band multi-layered chip antenna as set forth in claim 13, wherein the plurality of parasitic patterns of the second parasitic radiation element are uniformly spaced from each other.

* * * * *